US009190747B2

(12) United States Patent
Tateishi

(10) Patent No.: US 9,190,747 B2
(45) Date of Patent: Nov. 17, 2015

(54) CIRCUIT-TERMINAL CONNECTING DEVICE

(71) Applicant: DAI-ICHI SEIKO CO., LTD., Kyoto (JP)

(72) Inventor: Jin Tateishi, Ogoori (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 0 days.

(21) Appl. No.: 14/450,662

(22) Filed: Aug. 4, 2014

(65) Prior Publication Data

US 2015/0044887 A1 Feb. 12, 2015

(30) Foreign Application Priority Data

Aug. 8, 2013 (JP) ..... 2013-164918

(51) Int. Cl.

| | |
|---|---|
| ***H01R 12/62*** | (2011.01) |
| ***H01R 12/70*** | (2011.01) |
| ***H01R 12/71*** | (2011.01) |
| ***H01R 12/79*** | (2011.01) |

(52) U.S. Cl.

CPC ..... *H01R 12/7017* (2013.01); *H01R 12/716* (2013.01); *H01R 12/79* (2013.01)

(58) Field of Classification Search

CPC ..... H05K 3/365; H05K 1/118; H05K 3/326; H01R 12/62; H01R 23/725; H01R 9/096

See application file for complete search history.

(56) References Cited

U.S. PATENT DOCUMENTS

| | | | | |
|---|---|---|---|---|
| 5,370,552 | A * | 12/1994 | Chishima et al. | 439/495 |
| 6,811,431 | B2 * | 11/2004 | Hsieh | 439/495 |
| 7,374,435 | B2 * | 5/2008 | Idenishi | 439/77 |
| 7,654,829 | B1 * | 2/2010 | Chuang et al. | 439/67 |
| 7,766,666 | B1 * | 8/2010 | Chen et al. | 439/65 |
| 2007/0224848 | A1 * | 9/2007 | Takashita | 439/67 |
| 2008/0026609 | A1 * | 1/2008 | Kuwana et al. | 439/74 |

FOREIGN PATENT DOCUMENTS

| | | | |
|---|---|---|---|
| JP | H06-068940 | A | 3/1994 |
| JP | H08-031526 | A | 2/1996 |
| JP | 2003-297465 | A | 10/2003 |
| JP | 2012-252912 | A | 12/2012 |

* cited by examiner

*Primary Examiner* — Gary Paumen

(74) *Attorney, Agent, or Firm* — Studebaker & Brackett PC

(57) ABSTRACT

A circuit-terminal connecting device comprising an electrical connector having an insulated housing mounted on a main circuit board and a plurality of resilient contacts arranged on the insulated housing, and a flat circuit member having a reinforced portion attached to a reinforcing board member operative to engage with the insulated housing of the electrical connector, wherein each of the resilient contacts has a board connecting portion provided to be connected to a first circuit-terminal provided on the main circuit board, a fixable portion provided to be fixed to the insulated housing, and a resilient arm portion extending from the fixable portion and provided with a contact point for coming into press-contact with a second circuit-terminal provided on the reinforced portion of the flat circuit member and a locking portion for engaging with the reinforcing board member to lock the same.

4 Claims, 7 Drawing Sheets

CIRCUIT-TERMINAL CONNECTING DEVICE

BACKGROUND OF THE INVENTION

1. Field of the Invention

The present invention relates generally to a circuit-terminal connecting device, and more particularly to an improvement in a circuit-terminal connecting device used for connecting first circuit-terminals provided on a mail circuit board with second circuit-terminals provided on a flat circuit member, such as a flexible printed circuit board (hereinafter, referred to as an FPC), which is mounted on the main circuit board to be electrically coupled with the main circuit board.

2. Description of the Prior Art Including Information Disclosed Under 37 CFR 1.97 and 37 CFR 1.98

There has been proposed, for the purpose of saving a space in an electronic apparatus, to lay a flat circuit member, such as a relatively small-sized FPC, on top of a main circuit board on which various electrical or electronic parts are mounted when the flat circuit member is electrically coupled with the main circuit board in the electronic apparatus. Such an electrical coupling between the main circuit board and the flat circuit member wherein the flat circuit member is laid on top of the main circuit board is hereinafter referred to as an electrical piled coupling.

There have been also previously proposed several means for connecting a plurality of circuit-terminals provided on a flat circuit member, such as an FPC, respectively with a plurality of another circuit-terminals provided on a main circuit board in a condition wherein the main circuit board and the flat circuit member are put in the electrical piled coupling. With one of such means previously proposed, there has been constituted a circuit-terminal connecting structure in which an electrical connector having an insulated housing is mounted on a main circuit board, a flat circuit member is provided with a reinforced portion attached to a reinforcing board, and the reinforced portion of the flat circuit member attached to the reinforcing board is directly engaged with the insulated housing of the electrical connector so that a plurality of circuit-terminals provided on the reinforced portion of the flat circuit member are connected respectively with a plurality of circuit-terminals provided on the main circuit board, as disclosed in, for example, the Japanese patent application published before examination under publication number HEI 6-68940 (hereinafter, referred to as a published prior art document 1).

In the circuit-terminal connecting structure disclosed in the published prior art document 1, an electrical connector (a connector (3)) having an insulated housing (an insulator (30)) provided to be fixed to a main circuit board (a printed circuit board) is mounted on the main circuit board and a flat circuit member (an FPC cable (1)) has a reinforced portion thereof which is reinforced with a reinforcing board member (2). The insulated housing (30) of the electrical connector (3) is provided with a board member holding portion on which a plurality of contacts (33) are arranged and by which the reinforced portion of the flat circuit member (1) is held. A pair of board member locking portions (locking members (37)) are provided to stand respectively at a pair of end portions of the board holding portion in a direction along which the contacts (33) are arranged (a contact-arrangement direction) so that the contacts (33) are arranged between the board member locking portions (37) opposite to each other. An engaging hole (37*a*) is formed on each of the board member locking portions (37).

The reinforced portion of the flat circuit member (1) is provided with a plurality of circuit-terminal s arranged on a lower surface thereof and the reinforcing board member (2) attached to an upper surface thereof. The reinforced portion of the flat circuit member (1) with its lower surface on which the circuit-terminals are arranged is held, together with the reinforcing board member (2) attached thereto, by the board member holding portion of the insulated housing (30) of the electrical connector (3). The reinforcing board member (2) is provided with a pair of projections (engaging projections (23) formed respectively at a pair of end portions thereof in its longitudinal direction extending to be coincide with the contact-arrangement direction when the reinforcing board member (2) is held by the board member holding portion of the insulated housing (30).

When the reinforced portion of the flat circuit member (1) with the reinforcing board member (2) attached to the upper surface of the reinforced portion is held by the board member holding portion of the insulated housing (30) of the electrical connector (3), the contacts (33) arranged on the board member holding portion of the insulated housing (30) and soldered respectively to a plurality of circuit-terminal s of the main circuit board are caused to come into resilience-contact with the circuit-terminals arranged on the reinforced portion of the flat circuit member (1). Further, the projections (23) formed at the end portions of the reinforcing board member (2) attached to the reinforced portion of the flat circuit member (1) are put in engagement respectively with the engaging holes (37*a*) formed on the board member locking portions (37) standing respectively at the end portions of the board holding portion. Thereby, the end portions in the longitudinal direction of the reinforcing board member (2) are locked respectively by the board member locking portions (37) so that it is expected that a condition wherein the contacts (33) arranged on the board member holding portion of the electrical connector (3) are put in resilience-contact with the circuit-terminals arranged on the reinforced portion of the flat circuit member (1) is stably maintained.

When the end portions in the longitudinal direction of the reinforcing board member (2) are locked respectively by the board member locking portions (37) as described above in the circuit-terminal connecting structure disclosed in the published prior art document 1, the reinforced portion of the flat circuit member (1) and the reinforcing board member (2) attached thereto are resiliently pushed up from the side of the lower surface of the reinforced portion of the flat circuit member (1) by the contacts (33) arranged on the board member holding portion of the insulated housing (30) of the electrical connector (3). Thereby, it is feared that the reinforced portion of the flat circuit member (1) and the reinforcing board member (2) attached thereto are compulsorily curved so that a middle portion between the end portions in the longitudinal direction of the reinforcing board member (2) protrudes to go away from the board member holding portion of the insulated housing (30). If the reinforced portion of the flat circuit member (1) and the reinforcing board member (2) attached thereto are practically subjected to a condition to be curved as mentioned above, for example, the circuit-terminals arranged on the reinforced portion of the flat circuit member (1) are adversely affected by the curve brought about on the reinforced portion of the flat circuit member (1) and the reinforcing board member (2) attached thereto.

Accordingly, there has been further previously proposed an improved circuit-terminal connecting structure which is able to avoid the disadvantages accompanied with the above-described circuit-terminal connecting structure disclosed in the published prior art document 1, as disclosed in, for example, the Japanese patent application published before examination under publication number 2012-252912 (hereinafter, referred to as a published prior art document 2).

In the circuit-terminal connecting structure disclosed in the published prior art document 2, when a reinforced portion of a flat circuit member (a FPC cable (301)) is held, together with a reinforcing board member (a reinforcing board (304)), by a board member holding portion of an insulated housing (a housing (102)) of an electrical connector (a flat cable connector (101)) mounted on a main circuit board (a circuit board (201)), a pair of end portions in a longitudinal direction of the reinforcing board member (304) are locked respectively by a pair of board member locking portions (locking portions (103)) provided on the insulated housing (102). Under such a condition, a plurality of contacts (contacts (105)) arranged on the board member holding portion of the insulated housing (102) of the electrical connector (101) along the longitudinal direction of the reinforcing board member (304) and soldered respectively to a plurality of circuit-terminal s of the main circuit board (201) are caused to come into resilient-contact with a plurality of circuit-terminals (terminals (302A)) arranged on the reinforced portion of the flat circuit member (301). Thereby, the reinforced portion of the flat circuit member (301) and the reinforcing board member (304) attached thereto are resiliently pushed up from the side of a lower surface of the reinforced portion of the flat circuit member (301) by the contacts (105) arranged on the board member holding portion of the insulated housing (102) under the condition wherein the end portions in the longitudinal direction of the reinforcing board member (304) are locked respectively by the board member locking portions (103) provided on the insulated housing (102).

The reinforcing board member (304) attached to the reinforced portion of the flat circuit member (301) is provided, at one of side ends each extending in a longitudinal direction of the reinforcing board member (304), with a bent portion (an engaging projection (304E)) spreading over the side ends. The bent portion (304E) is operative to prevent the reinforcing board member (304) from being curved in the longitudinal direction of the reinforcing board member (304). As a result, even if the reinforced portion of the flat circuit member (301) and the reinforcing board member (304) attached thereto are resiliently pushed up from the side of the lower surface of the reinforced portion of the flat circuit member (301) by the contacts (105) arranged on the board member holding portion of the insulated housing (102) under the condition wherein the end portions in the longitudinal direction of the reinforcing board member (304) are locked respectively by the board member locking portions (103) provided on the insulated housing (102), the reinforced portion of the flat circuit member (301) and the reinforcing board member (304) attached thereto are prevented, by the bent portion (304E) provided at the side end of the reinforcing board member (304) to spread over the same, from being caused to curve in the longitudinal direction of the reinforcing board member (304) so that a middle portion between the end portions in the longitudinal direction of the reinforcing board member (304) is also prevented from protruding to go away from the board member holding portion of the insulated housing (102).

In the case of such a previously proposed circuit-terminal connecting structure used as disclosed in the published prior art document 2 in which the circuit-terminal s provided on the flat circuit member are caused to come into contact respectively with circuit-terminals provided on the main circuit board under the condition wherein the main circuit board and the flat circuit member are put in the electrical piled coupling, it is also desired to reduce as much as practicable a thickness of the electrical connector mounted on the main circuit board and therefore it is considered to make the insulated housing of the electrical connector relatively thin so that the electrical connector is subjected to reduction in thickness.

When the insulated housing of the electrical connector is made to be relatively thin so as to reduce the thickness of the electrical connector, the stiffness of the insulated housing is also reduced undesirably. Under a condition wherein the insulated housing of the electrical connector is made to be relatively thin, when the reinforcing board member attached to the reinforced portion of the flat circuit member is provided with the bent portion spreading over the side end extending in the longitudinal direction of the reinforcing board member and thereby the reinforced portion of the flat circuit member and the reinforcing board member attached thereto are prevented, by the bent portion provided at the side end of the reinforcing board member, from being caused to curve in the longitudinal direction of the reinforcing board member so that the middle portion between the end portions in the longitudinal direction of the reinforcing board member is also prevented from protruding to go away from the board member holding portion of the insulated housing even if the reinforced portion of the flat circuit member and the reinforcing board member attached thereto are resiliently pushed up from the side of the lower surface of the reinforced portion of the flat circuit member by the contacts arranged on the board member holding portion of the insulated housing under the condition wherein the end portions in the longitudinal direction of the reinforcing board member are locked respectively by the board member locking portions provided on the insulated housing, a resilient press-force caused to act on the reinforced portion of the flat circuit member and the reinforcing board member attached thereto by the contacts arranged on the board member holding portion of the insulated housing brings about a reactive force acting on the insulated housing. With such a reactive force thus brought about, it is feared that the insulated housing with its stiffness undesirably reduced is compulsorily curved so that a middle portion between a pair of end portions of the insulating housing opposite to each other in a longitudinal direction of the insulating housing along which the contacts are arranged protrudes to go away from the flat circuit member and the reinforcing board member attached thereto.

In the case where the insulated housing with its stiffness undesirably reduced is compulsorily curved in such a manner as mentioned above, an undesirable stress is inflicted on soldering portions on the main circuit board at which the contacts arranged on the insulated housing are soldered respectively to the circuit-terminals provided on the main circuit board and thereby it is feared that undesirable cracks are brought about on the soldering portions.

BRIEF SUMMARY OF THE INVENTION

Accordingly, it is an object of the present invention to provide a circuit-terminal connecting device which comprises an electrical connector having an insulated housing mounted on a main circuit board on which a plurality of first circuit-terminals are provided and a plurality of resilient contacts arranged on the insulated housing and is used for causing the resilient contacts to come into contact respectively with a plurality of second circuit-terminals provided on a flat circuit member, such as an FPC, so as to connect electrically the second circuit-terminals provided on the flat circuit member with the first circuit-terminal s provided on the main circuit board, and which avoids the aforementioned problems and disadvantages encountered with the prior art.

Another object of the present invention is to provide a circuit-terminal connecting device which comprises an electrical connector having an insulated housing mounted on a main circuit board on which a plurality of first circuit-terminals are provided and a plurality of resilient contacts arranged on the insulated housing and is used for causing the resilient contacts to come into contact respectively with a plurality of second circuit-terminals provided on a flat circuit member, such as an FPC, so as to connect electrically the second circuit-terminals provided on the flat circuit member with the first circuit-terminals provided on the main circuit board, and with which the insulated housing of the electrical connector can be prevented from being caused to curve with a reactive force brought about to act on the insulated housing by a resilient press-force caused to act on the flat circuit member by the resilient contacts even if the insulated housing is made to be relatively thin so as to reduce the thickness of the electrical connector and thereby the stiffness of the insulated housing is also reduced undesirably.

According to the present invention, there is provided a circuit-terminal connecting device which comprises an electrical connector having an insulated housing mounted on a main circuit board and a plurality of resilient contacts arranged on the insulated housing, each of which has a board connecting portion provided to be connected respectively to a plurality of first circuit-terminals provided on the main circuit board, and a flat circuit member having a reinforced portion attached to one of first and second surface portions opposite to each other of a reinforcing board member which is operative to engage with the insulated housing of the electrical connector and provided thereon a plurality of second circuit-terminals. The resilient contacts include first and second contacts arranged one after the other, and each of the first and second contacts has, in addition to the board connecting portion, a fixable portion provided to be fixed to the insulated housing and a resilient arm portion extending from the fixable portion to get under the board member accommodating portion provided on the insulated housing. The resilient arm portion of each of the first and second contacts is provided with a contact point for coming into press-contact with the second circuit-terminal provided on the reinforced portion of the flat circuit member so as to cause the second circuit-terminals to be electrically connected respectively with the first circuit-terminals provided on the main circuit board through the first and second contacts and a locking portion for engaging with the other of the first and second surface portions of the reinforcing board member to lock the reinforcing board member. The insulated housing of the electrical connector is provided thereon with a board member accommodating portion for accommodating the reinforcing board member accompanied with the reinforced portion of the flat circuit member. A first portion of the insulated housing to which the fixable portion of each of the first contacts is fixed and a second portion of the insulated housing to which the fixable portion of each of the second contacts is fixed are provided to be opposite to each other with the board member accommodating portion of the insulated housing provided between the first and second portions. The contact point provided on the resilient arm portion extending from the fixable portion of each of the first contacts and the locking portion provided on the resilient arm portion extending from the fixable portion of each of the second contacts are placed on the side of the second portion of the insulated housing, and the contact point provided on the resilient arm portion extending from the fixable portion of each of the second contacts and the locking portion provided on the resilient arm portion extending from the fixable portion of each of the first contacts are placed on the side of the first portion of the insulated housing.

In the circuit-terminal connecting device thus constituted in accordance with the present invention, when the reinforcing board member having the first and second surfaces opposite to each other, to one of which the reinforced portion of the flat circuit member is attached, is accommodated, together with the reinforced portion of the flat circuit member, in the board member accommodating portion of the insulated housing of the electrical connector, each of the first contacts arranged on the insulated housing causes the contact point provided on the resilient arm portion thereof to come into contact with the second circuit-terminal provided on the reinforced portion of the flat circuit member attached to the reinforcing board member which is accommodated in the board member accommodating portion of the insulated housing on the side of the second portion of the insulated housing to which the fixable portion of each of the second contacts is fixed and further causes the locking portion provided on the resilient arm portion thereof to engage with the other of the first and second surface portions of the reinforcing board member for locking the reinforcing board member in the board member accommodating portion of the insulated housing on the side of the first portion of the insulated housing to which the fixable portion of each of the first contacts is fixed, and each of the second contacts arranged on the insulated housing causes the contact point provided on the resilient arm portion thereof to come into contact with the second circuit-terminal provided on the reinforced portion of the flat circuit member attached to the reinforcing board member which is accommodated in the board member accommodating portion of the insulated housing on the side of the first portion of the insulated housing and further causes the locking portion provided on the resilient arm portion thereof to engage with the other of the first and second surface portions of the reinforcing board member for locking the reinforcing board member in the board member accommodating portion of the insulated housing on the side of the second portion of the insulated housing.

In such a manner as mentioned above, the contact point provided on the resilient arm portion of each of the first and second contacts which are arranged one after the other with the board connecting portions connected respectively with the first circuit-terminals provided on the main circuit board, is caused to come into contact with the second circuit-terminal provided on the flat circuit member and thereby the second circuit-terminals provided on the flat circuit member are electrically connected respectively with the first circuit-terminals provided on the main circuit board through the resilient contacts provided in the electrical connector. In that case, the contact point provided on the resilient arm portion of each of the first contacts is operative to inflict a resilient press-force upon the reinforced portion of the flat circuit member attached to the reinforcing board member through the second circuit-terminal provided thereon to push the same toward one of the first and second surface portions of the reinforcing board member on the side of the second portion of the insulated housing and the locking portion provided on the resilient arm portion of each of the first contacts is operative to engage with the other of the first and second surface portions of the reinforcing board member for locking the reinforcing board member on the side of the first portion of the insulated housing. Further, the contact point provided on the resilient arm portion of each of the second contacts is operative to inflict a resilient press-force upon the reinforced portion of the flat circuit member attached to the reinforcing board member through the second circuit-terminal provided thereon to push the same toward one of the first and second surface portions of the reinforcing board member on the side of the first portion of the insulated housing and the locking portion provided on the resilient arm portion of each of the second contacts is operative to engage with the other of the first and second surface portions of the reinforcing board member for locking the reinforcing board member on the side of the second portion of the insulated housing.

Consequently, under the condition wherein the first and second portions of the insulated housing are opposite to each other with the board member accommodating portion of the insulated housing provided between the first and second portions, on the side of the second portion of the insulated housing, the resilient press-force inflicted upon the flat circuit member by the contact point of each of the first contacts is received through the reinforced portion of the flat circuit member and the reinforcing board member by the locking portion of each of the second contact, and on the side of the first portion of the insulated housing, the resilient press-force inflicted upon the flat circuit member by the contact point of each of the second contacts is received through the reinforced portion of the flat circuit member and the reinforcing board member by the locking portion of each of the first contact.

With the circuit-terminal connecting device according to the present invention, when the reinforcing board member to which the reinforced portion of the flat circuit member is attached is accommodated in the board member accommodating portion of the insulated housing, since the resilient press-force inflicted upon the flat circuit member by the contact point of each of the first contacts is received by the locking portion of each of the second contacts and the resilient press-force inflicted upon the flat circuit member by the contact point of each of the second contacts is received by the locking portion of each of the first contacts in such a manner as described above, the insulated housing of the electrical connector can be prevented from being caused to curve with a reactive force brought about to act on the insulated housing by the resilient press-force caused to act on the flat circuit member by the first and second contacts constituting the resilient contacts even if the insulated housing is made to be relatively thin so as to reduce the thickness of the electrical connector and thereby the stiffness of the insulated housing is also reduced undesirably. As a result, the circuit-terminal connecting device according to the present invention is able to avoid such a disadvantage that an undesirable stress is inflicted on soldering portions on the main circuit board at which the first and second contacts arranged on the insulated housing of the electrical connector are soldered respectively to the circuit-terminals provided on the main circuit board so that undesirable cracks are brought about on the soldering portions.

The above, and other objects, features and advantages of the present invention will become apparent from the following detailed description taken in conjunction with the accompanying drawings.

DETAILED DESCRIPTION OF THE INVENTION

Figure 1:
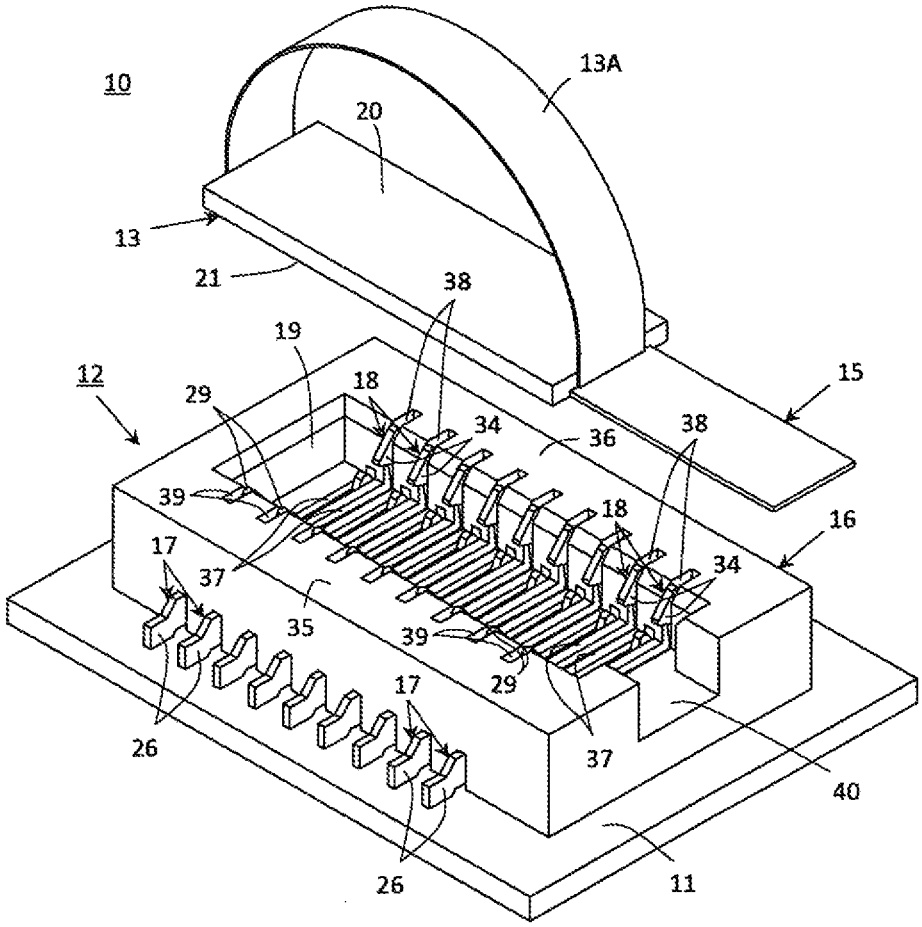
FIG. 1 is a schematic perspective view showing an embodiment of circuit-terminal connecting device which comprises an electrical connector having an insulated housing mounted on a main circuit board and a flat circuit member having a reinforced portion thereof attached to a reinforcing board member.

FIG. 1 shows an electrical connector and a flat circuit member which are main structural components of an embodiment of circuit-terminal connecting device according to the present invention.

Figure 2:
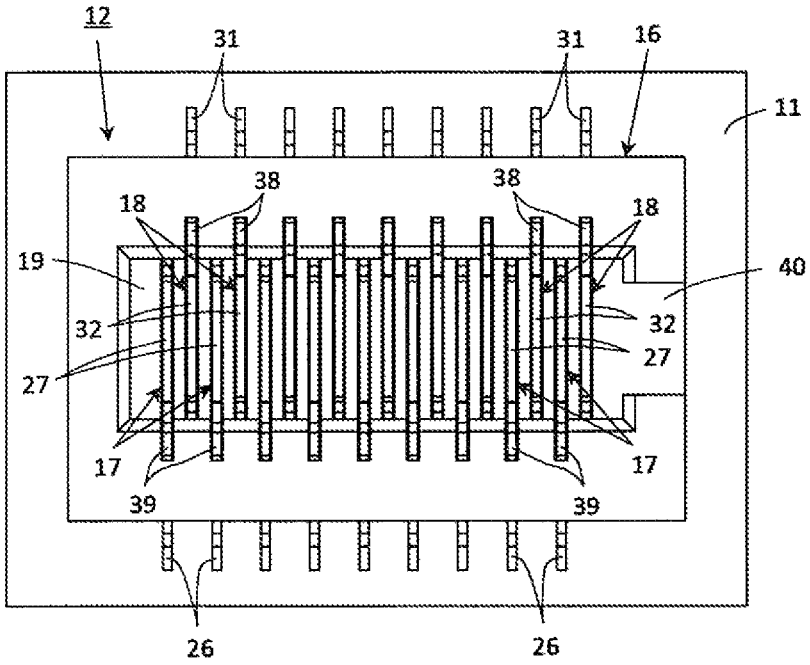
FIG. 2 is a schematic plan view showing the electrical connector shown in FIG. 1 which has the insulated housing mounted on the main circuit board.
Figure 11:
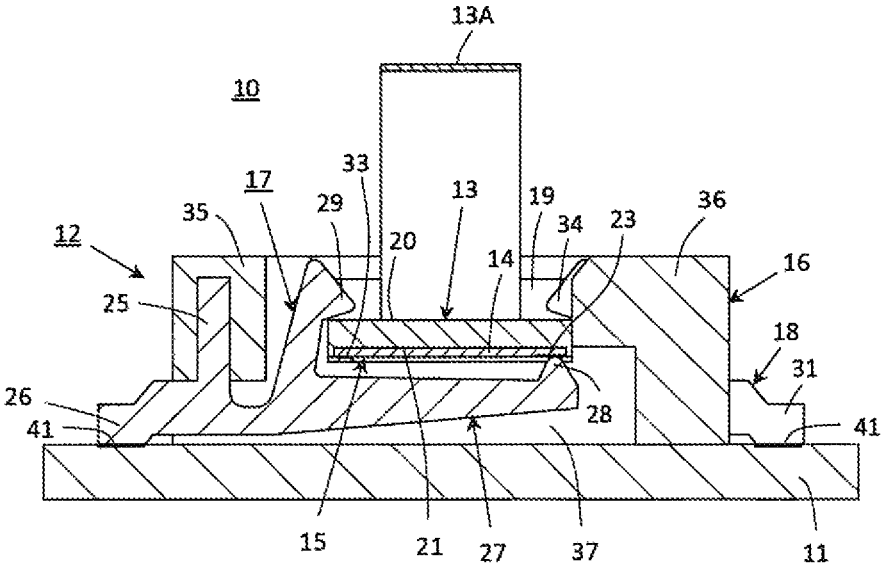
FIG. 11 is a schematic cross-sectional view taken along line XI-XI in FIG. 10.

Referring to FIG. 1, a circuit-terminal connecting device 10, which constitutes the embodiment of circuit-terminal connecting device according to the present invention, comprises an electrical connector 12 provided on a main circuit board 11 and a flat circuit member 15, such as an FPC shaped into a strip, having a reinforced portion 14 thereof (shown in FIGS. 11 and 12 explained later) attached to a reinforcing board member 13 configured to be rectangular for engaging with the electrical connector 12. The electrical connector 12 has an insulated housing 16 mounted on the main circuit board 11 and a plurality of resilient contacts including first contacts 17 and second contacts 18 arranged one after the other on the insulated housing 16, as shown also in FIGS. 2 and 3 in each of which the electrical connector 12 is shown. The insulated housing 16 is provided with a board member accommodating portion 19 shaped into a rectangular hole for accommodating the reinforcing board member 13 accompanied with the reinforced portion 14 of the flat circuit member 15. The board member accommodating portion 19 has an opening portion opened into a direction perpendicular to a surface of the main circuit board 11 on which the insulated housing 16 is fixed.

The reinforcing board member 13 accompanied with the reinforced portion 14 of the flat circuit member 15 has first and second surface portions 20 and 21 opposite to each other and the reinforced portion 14 of the flat circuit member 15 is attached to the second surface portion 21 of the reinforcing board member 13 so as to be buried in the second surface portion 21. A plurality of circuit-terminals 23 (shown in FIGS. 11 and 12 explained later) are provided on a surface of the reinforced portion 14 of the flat circuit member 15, which is operative to face a bottom of the board member accommodating portion 19 when the reinforced portion 14 of the flat circuit member 15 is accommodated in the board member accommodating portion 19.

The reinforcing board member 13 accompanied with the reinforced portion 14 of the flat circuit member 15 is accommodated in the board member accommodating portion 19 through the opening portion of the same so as to cause the reinforced portion 14 of the flat circuit member 15 to be opposite to the bottom of the board member accommodating portion 19. A tape-handle 13A is attached to the reinforcing board member 13 to be used for pulling the reinforcing board member 13 accommodated in the board member accommodating portion 19 out of the board member accommodating portion 19.

Figure 4:
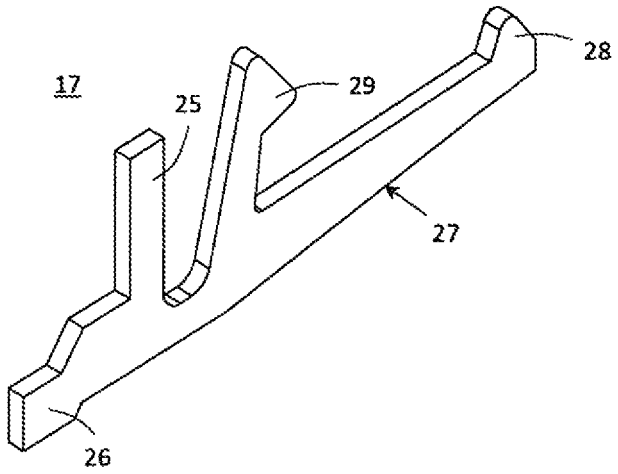
FIG. 4 is a schematic perspective view showing a first contact provided in the electrical connector shown in FIG. 1.

As shown in FIG. 4, each of the first contacts 17 is made of resilient metallic plate subjected to punching and bending process to have a fixable portion 25 provided to be fixed to the insulated housing 16, a board connecting portion 26 extending from the fixable portion 25 to be connected to a circuit-terminal 41 (shown in FIGS. 6, 7, 11 and 12 explained later) provided on the main circuit board 11 and a resilient arm portion 27 extending from the fixable portion 25 in a direction opposite to the board connecting portion 26. The resilient arm portion 27 is provided at its top end portion with a contact point 28 for coming into press-contact with the circuit-terminal 23 on the reinforced portion 14 of the flat circuit member 15 and further provided in the vicinity of the fixable portion 25 with a locking portion 29 for engaging with the first surface portion 20 of the reinforcing board member 13 to lock the reinforcing board member 13.

Figure 5:
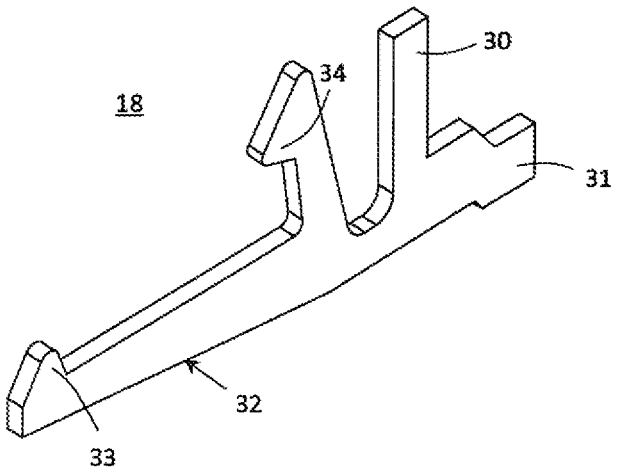
FIG. 5 is a schematic perspective view showing a second contact provided in the electrical connector shown in FIG. 1.

Similarly, as shown in FIG. 5, each of the second contacts 18 is made of resilient metallic plate subjected to punching and bending process to have a fixable portion 30 provided to be fixed to the insulated housing 16, a board connecting portion 31 extending from the fixable portion 30 to be connected with the circuit-terminal 41 on the main circuit board 11 and a resilient arm portion 32 extending from the fixable portion 30 in a direction opposite to the board connecting portion 31. The resilient arm portion 32 is provided at its top end portion with a contact point 33 for coming into press-contact with the circuit-terminal 23 on the reinforced portion 14 of the flat circuit member 15 and further provided in the vicinity of the fixable portion 30 with a locking portion 34 for engaging with the first surface portion 20 of the reinforcing board member 13 to lock the reinforcing board member 13.

The insulated housing 16 has a pair of portions 35 and 36 each elongating in a direction along which the first and second contacts 17 and 18 are arranged one after the other to be opposite to each other with the board member accommodating portion 19 between the portions 35 and 36. The fixable portion 25 of each of the first contacts 17 is fixed to the portion 35 of the insulated housing 16 and the resilient arm portion 27 of each of the first contacts 17 extends from the fixable portion 25 fixed to the portion 35 of the insulated housing 16 toward the portion 36 of the insulated housing 16 to get under the board member accommodating portion 19 and the fixable portion 30 of each of the second contacts 18 is fixed to the portion 36 of the insulated housing 16 and the resilient arm portion 32 of each of the second contacts 18 extends from the fixable portion 30 fixed to the portion 36 of the insulated housing 16 toward the portion 35 of the insulated housing 16 to get under the board member accommodating portion 19. Accordingly, the resilient arm portion 27 extending from the fixable portion 25 of each of the first contacts 17 and the resilient arm portion 32 extending from the fixable portion 30 of each of the second contacts 18 elongate respectively in directions opposite to each other.

The resilient arm portion 27 of each of the first contacts 17 is put in one of slits 37 formed to be arranged on the bottom of the board member accommodating portion 19 provided on the insulated housing 16 so as to cause the contact point 28 provided thereon to enter into the board member accommodating portion 19 and the resilient arm portion 32 of each of the second contacts 18 is put in another of the slits 37 so as to cause the contact point 33 provided thereon to enter into the board member accommodating portion 19. The locking portion 29 provided on the resilient arm portion 27 of each of the first contacts 17 is put in one of slits 39 formed to be arranged on the portion 35 of the insulated housing 16 and the locking portion 34 provided on the resilient arm portion 32 of the second contact 18 is put in one of slits 38 formed to be arranged on the portion 36 of the insulated housing 16.

Figure 3:
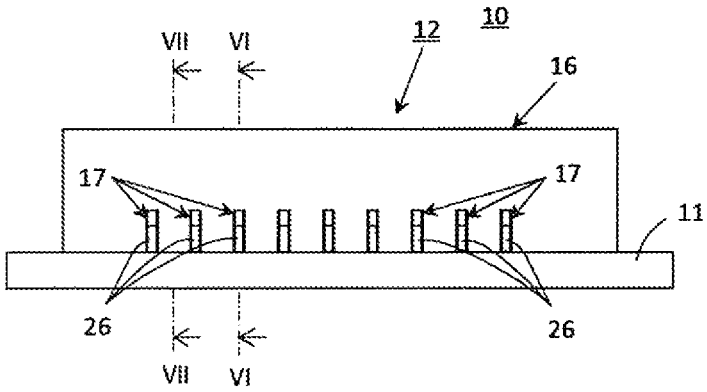
FIG. 3 is a schematic side view showing the electrical connector shown in FIG. 1 which has the insulated housing mounted on the main circuit board.
Figure 6:
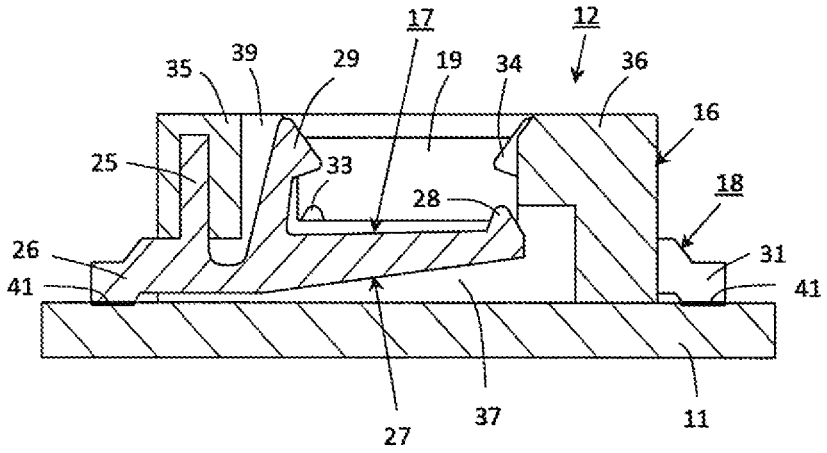
FIG. 6 is a schematic cross-sectional view taken along line VI-VI in FIG. 3.
Figure 7:
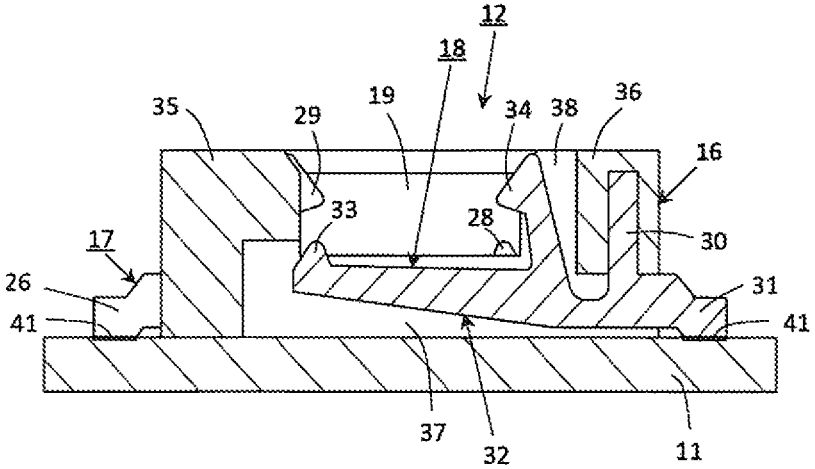
FIG. 7 is a schematic cross-sectional view taken along line VII-VII in FIG. 3.

As shown in FIG. 6 showing a cross-section taken along line VI-VI in FIG. 3, in the board member accommodating portion 19 provided on the insulated housing 16, the contact point 28 provided on the resilient arm portion 27 of each of the first contacts 17 is positioned in the vicinity of the portion 36 of the insulated housing 16 to which the fixable portion 30 of each of the second contacts 18 is fixed and the locking portion 29 provided on the resilient arm portion 27 of each of the first contacts 17 is positioned in the vicinity of the portion 35 of the insulated housing 16 to which the fixable portion 25 of each of the first contacts 17 is fixed. Further, as shown in FIG. 7 showing a cross-section taken along line VII-VII in FIG. 3, in the board member accommodating portion 19 provided on the insulated housing 16, the contact point 33 provided on the resilient arm portion 32 of each of the second contacts 18 is positioned in the vicinity of the portion 35 of the insulated housing 16 to which the fixable portion 25 of each of the first contacts 17 is fixed and the locking portion 34 provided on the resilient arm portion 32 of each of the second contacts 18 is positioned in the vicinity of the portion 36 of the insulated housing 16 to which the fixable portion 30 of each of the second contacts 18 is fixed.

When the flat circuit member 15 having the reinforced portion 14 thereof attached to the reinforcing board member 13 is put in engagement with the electrical connector 12 having the insulated housing 16 mounted on the main circuit board 11, the reinforcing board member 13 accompanied with the reinforced portion 14 of the flat circuit member 15 is accommodated in the board member accommodating portion 19 provided on the insulated housing 16 of the electrical connector 12 through the opening portion of the same so as to cause the reinforced portion 14 of the flat circuit member 15 to be opposite to the bottom of the board member accommodating portion 19. Thereby, the electrical connector 12 provided on the main circuit board 11 and the flat circuit member 15 having the reinforced portion 14 thereof attached to the reinforcing board member 13 are put in a condition shown in each of FIGS. 8 (a perspective view), 9 (a plan view) and 10 (a side view).

Figure 8:
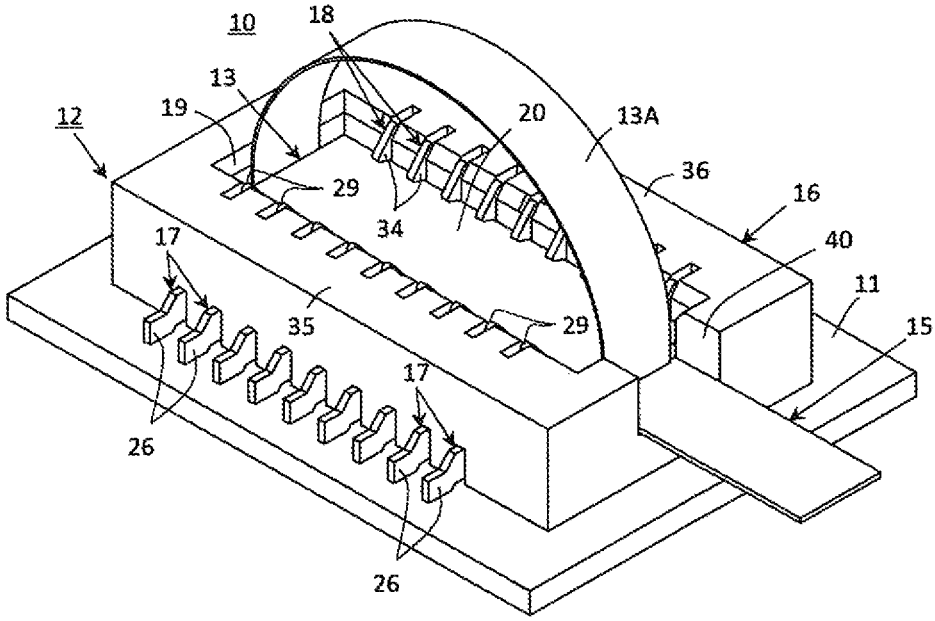
FIG. 8 is a schematic perspective view showing the electrical connector shown in FIG. 1 and the reinforcing board member to which the reinforced portion of the flat circuit member is attached as shown in FIG. 1 and which is put in engagement with the electrical connector.
Figure 9:
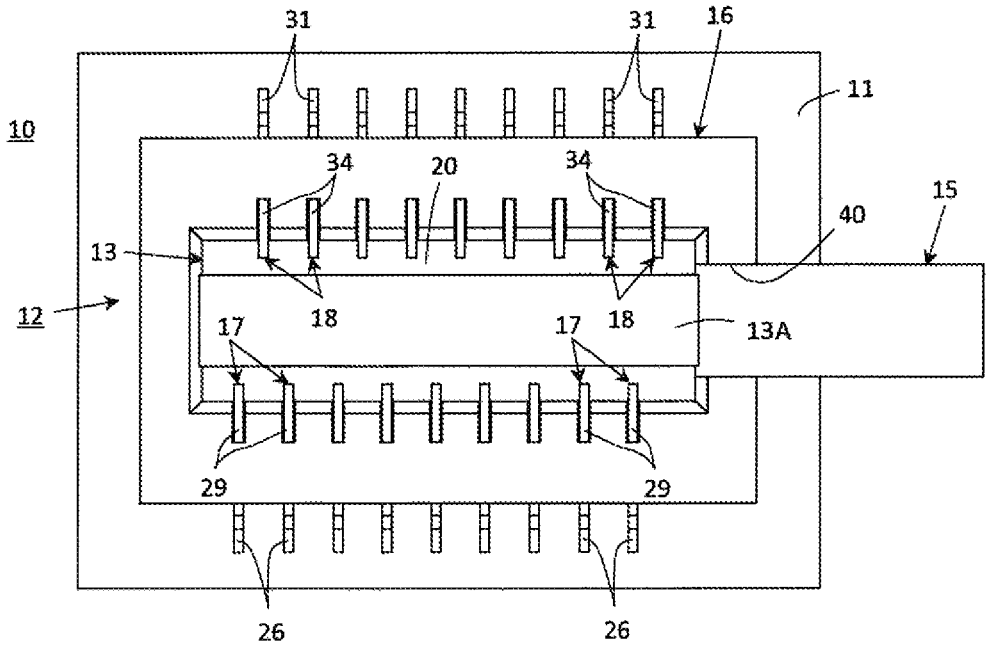
FIG. 9 is a schematic plan view showing the electrical connector shown in FIG. 1 and the reinforcing board member to which the reinforced portion of the flat circuit member is attached as shown in FIG. 1 and which is put in engagement with the electrical connector.
Figure 10:
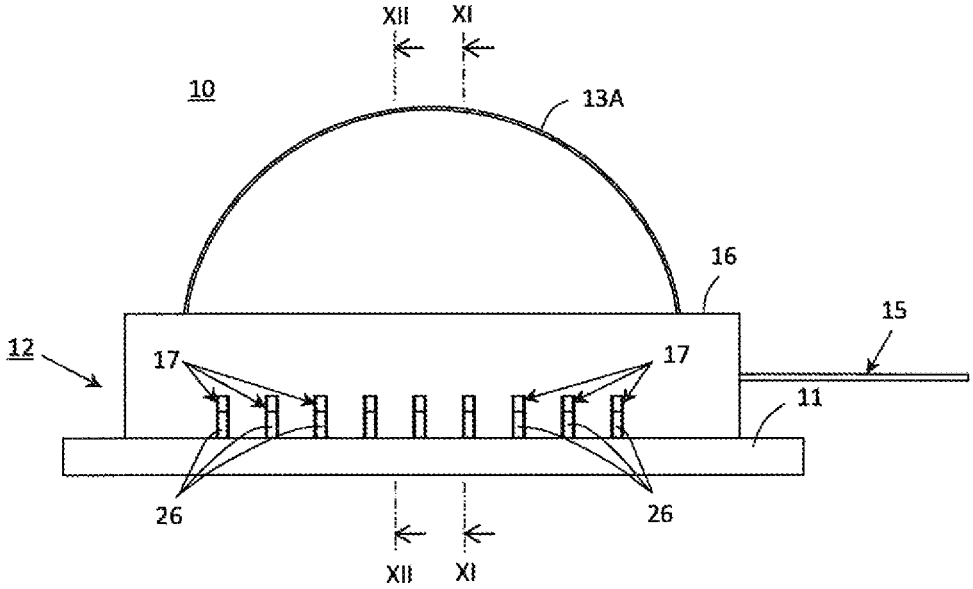
FIG. 10 is a schematic side view showing the electrical connector shown in FIG. 1 and the reinforcing board member to which the reinforced portion of the flat circuit member is attached as shown in FIG. 1 and which is put in engagement with the electrical connector.

As shown in each of FIGS. 8 to 10, when the flat circuit member 15 is accommodated in the board member accommodating portion 19 provided on the insulated housing 16, a portion of the flat circuit member 15 having the reinforced portion 14 thereof attached to the reinforcing board member 13 projects to the outside of the insulated housing 16 through a cutout 40 formed on the insulated housing 16. The tape-handle 13A attached to the reinforcing board member 13 is positioned on the insulated housing 16 to project above.

Under a condition wherein the reinforcing board member 13 accompanied with the reinforced portion 14 of the flat circuit member 15 is accommodated in the board member accommodating portion 19 provided on the insulated housing 16 of the electrical connector 12 in such a manner as mentioned above, as shown in FIG. 11 showing a cross-section taken along line XI-XI in FIG. 10, each of the first contacts 17 arranged on the insulated housing 16 with the board connecting portion 26 connected to the circuit-terminal 41 on the main circuit board 11 is operative to cause the contact point 28 provided on the resilient arm portion 27 and positioned in the vicinity of the portion 36 of the insulated housing 16 to come into press-contact with the circuit-terminal 23 on the reinforced portion 14 of the flat circuit member 15 and further to cause the locking portion 29 provided on the resilient arm portion 27 and positioned in the vicinity of the portion 35 of the insulated housing 16 to engage with the first surface portion 20 of the reinforcing board member 13 for locking the reinforcing board member 13 in the board member accommodating portion 19 provided on the insulated housing 16.

Figure 12:
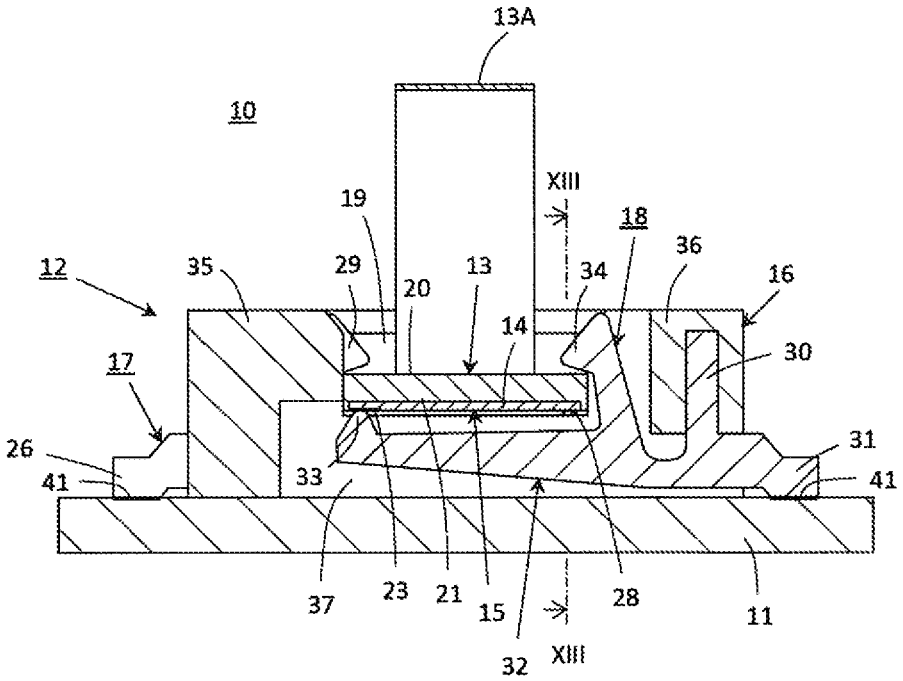
FIG. 12 is a schematic cross-sectional view taken along line XII-XII in FIG. 10.

Similarly, as shown in FIG. 12 showing a cross-section taken along line XII-XII in FIG. 10, each of the second contacts 18 arranged on the insulated housing 16 with the board connecting portion 31 thereof connected to the circuit-terminal 41 on the main circuit board 11 is operative to cause the contact point 33 provided on the resilient arm portion 32 and positioned in the vicinity of the portion 35 of the insulated housing 16 to come into press-contact with the circuit-terminal 23 on the reinforced portion 14 of the flat circuit member 15 and further to cause the locking portion 34 provided on the resilient arm portion 32 and positioned in the vicinity of the portion 36 of the insulated housing 16 to engage with the first surface portion 20 of the reinforcing board member 13 for locking the reinforcing board member 13 in the board member accommodating portion 19 provided on the insulated housing 16.

With the contact point 28 provided on the resilient arm portion 27 of each of the first contacts 17 each having the board connecting portion 26 connected to the circuit-terminal 41 on the main circuit board 11 so as to be caused to come into press-contact with the circuit-terminal 23 on the reinforced portion 14 of the flat circuit member 15 and the contact point 33 provided on the resilient arm portion 32 of each of the second contacts 18 each having the board connecting portion 31 connected to the circuit-terminal 41 on the main circuit board 11 so as to be caused to come into press-contact with the circuit-terminal 23 on the reinforced portion 14 of the flat circuit member 15, the circuit-terminals 23 on the reinforced portion 14 of the flat circuit member 15 are electrically connected to the circuit-terminals 41 on the main circuit board 11 through the first contacts 17 and the second contacts 18.

In that case, the contact point 28 provided on the resilient arm portion 27 of each of the first contacts 17 is operative to inflict a resilient press-force upon the reinforced portion 14 of the flat circuit member 15 attached to the reinforcing board member 13 through the circuit-terminal 23 provided on the reinforced portion 14 of the flat circuit member 15 to push the reinforced portion 14 of the flat circuit member 15 toward the first surface portion 20 of the reinforcing board member 13 on the side of the portion 36 of the insulated housing 16 and the locking portion 29 provided on the resilient arm portion 27 of each of the first contacts 17 is operative to engage with the first surface portion 20 of the reinforcing board member 13 for locking the reinforcing board member 13 on the side of the portion 35 of the insulated housing 16. Further, the contact point 33 provided on the resilient arm portion 32 of each of the second contacts 18 is operative to inflict a resilient press-force upon the reinforced portion 14 of the flat circuit member 15 attached to the reinforcing board member 13 through the circuit-terminal 23 provided on the reinforced portion 14 of the flat circuit member 15 to push the reinforced portion 14 of the flat circuit member 15 toward the first surface portion 20 of the reinforcing board member 13 on the side of the portion 35 of the insulated housing 16 and the locking portion 34 provided on the resilient arm portion 32 of each of the second contacts 18 is operative to engage with the first surface portion 20 of the reinforcing board member 13 for locking the reinforcing board member 13 on the side of the portion 36 of the insulated housing 16.

Figure 13:
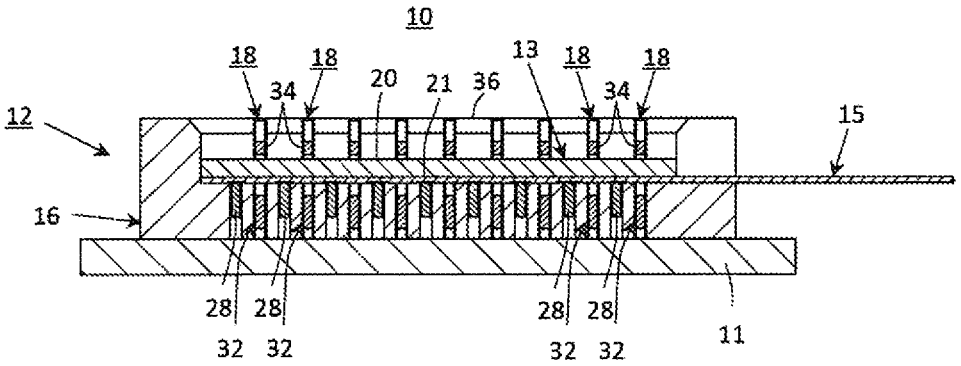
FIG. 13 is a schematic cross-sectional view taken along line XIII-XIII in FIG. 12.

Consequently, as shown in FIG. 13 showing a cross-section taken along line XIII-XIII in FIG. 12, under the condition wherein the portions 35 and 36 of the insulated housing 16 are opposite to each other with the board member accommodating portion 19 of the insulated housing 16 provided between the portions 35 and 36, on the side of the portion 36 of the insulated housing 16, the resilient press-force inflicted upon the flat circuit member 15 by the contact point 28 of each of the first contacts 17 is received through the reinforced portion 14 of the flat circuit member 15 and the reinforcing board member 13 by the locking portion 34 of each of the second contacts 18, and on the side of the portion 35 of the insulated housing 16, the resilient press-force inflicted upon the flat circuit member 15 by the contact point 33 of each of the second contacts 18 is received through the reinforced portion 14 of the flat circuit member 15 and the reinforcing board member 13 by the locking portion 29 of each of the first contacts 17.

Further, since the first contacts 17 and the second contacts 18 are arranged one after the other on the insulated housing 16 of the electrical connector 12, a first linear arrangement of contact-portions, at each of which the contact point 28 provided on the first contact 17 comes into press-contact with the circuit-terminal 23 on the reinforced portion 14 of the flat circuit member 15, and a second linear arrangement of contact-portions, at each of which the contact point 33 provided on the second contact 18 comes into press-contact with the circuit-terminal 23 on the reinforced portion 14 of the flat circuit member 15, are formed to be parallel with each other. The first linear arrangement of contact-portions is made in the vicinity of the portion 36 of the insulated housing 16 to which the fixable portion 30 of each of the second contacts 18 is fixed and the second linear arrangement of contact-portions is made in the vicinity of the portion 35 of the insulated housing 16 to which the fixable portion 25 of each of the first contacts 17 is fixed.

Similarly, a third linear arrangement of engagement-portions, at each of which the locking portion 29 provided on the first contact 17 engages with the first surface portion 20 of the reinforcing board member 13 to lock the reinforcing board member 13, and a fourth linear arrangement of engagement-portions, at each of which the locking portion 34 provided on the second contact 18 engages with the first surface portion 20 of the reinforcing board member 13 to lock the reinforcing board member 13, are formed to be parallel with each other. The third linear arrangement of engagement-portions is made in the vicinity of the portion 35 of the insulated housing 16 to which the fixable portion 25 of each of the first contacts 17 is fixed and the second linear arrangement of engagement-portions is made in the vicinity of the portion 36 of the insulated housing 16 to which the fixable portion 30 of each of the second contacts 18 is fixed.

In the circuit-terminal connecting device 10 thus constituted in accordance with the present invention, when the reinforcing board member 13 accompanied with the reinforced portion 14 of the flat circuit member 15 is accommodated in the board member accommodating portion 19 provided on the insulated housing 16 of the electrical connector 12, the contact point 28 provided on the resilient arm portion 27 of each of the first contacts 17 arranged on the insulated housing 16 of the electrical connector 12 comes into press-contact with the circuit-terminal 23 on the reinforced portion 14 of the flat circuit member 15 and the contact point 33 provided on the resilient arm portion 32 of each of the second contacts 18 arranged also on the insulated housing 16 comes into press-contact with the circuit-terminal 23 on the reinforced portion 14 of the flat circuit member 15, so that the circuit-terminals 23 on the reinforced portion 14 of the flat circuit member 15 are electrically connected to the circuit-terminals 41 on the main circuit board 11 through the first contacts 17 and the second contacts 18.

In that case, under the condition wherein the portions 35 and 36 of the insulated housing 16 are opposite to each other with the board member accommodating portion 19 of the insulated housing 16 provided between the portions 35 and 36, on the side of the portion 36 of the insulated housing 16, the resilient press-force inflicted upon the flat circuit member 15 by the contact point 28 of each of the first contacts 17 is received through the reinforced portion 14 of the flat circuit member 15 and the reinforcing board member 13 by the locking portion 34 of each of the second contacts 18, and on the side of the portion 35 of the insulated housing 16, the resilient press-force inflicted upon the flat circuit member 15 by the contact point 33 of each of the second contacts 18 is received through the reinforced portion 14 of the flat circuit member 15 and the reinforcing board member 13 by the locking portion 29 of each of the first contacts 17.

Consequently, with the circuit-terminal connecting device 10, since the resilient press-force inflicted upon the flat circuit member 15 by the contact point 28 of each of the first contacts 17 is received by the locking portion 34 of each of the second contacts 18 and the resilient press-force inflicted upon the flat circuit member 15 by the contact point 33 of each of the second contacts 18 is received by the locking portion 29 of each of the first contacts 17 when the reinforcing board member 13 to which the reinforced portion 14 of the flat circuit member 15 is attached is accommodated in the board member accommodating portion 19 provided on the insulated housing 16 of the electrical connector 12, the insulated housing 16 of the electrical connector 12 can be prevented from being caused to curve with a reactive force brought about to act on the insulated housing 16 by the resilient press-force caused to act on the flat circuit member 15 by the first and second contacts 17 and 18 constituting the resilient contacts even if the insulated housing 16 is made to be relatively thin so as to reduce the thickness of the electrical connector 12 and thereby the stiffness of the insulated housing 16 is also reduced undesirably. As a result, the circuit-terminal connecting device 10 is able to avoid such a disadvantage that an undesirable stress is inflicted on soldering portions on the main circuit board 11 at which the first and second contacts 17 and 18 arranged on the insulated housing 16 of the electrical connector 12 are soldered respectively to the circuit-terminals 41 on the main circuit board 11 so that undesirable cracks are brought about on the soldering portions.

Further, in the circuit-terminal connecting device 10, the first contacts 17 and the second contacts 18 are arranged one after the other on the insulated housing 16 of the electrical connector 12, so that the first linear arrangement of contact-portions, at each of which the contact point 28 provided on the first contact 17 comes into press-contact with the circuit-terminal 23 on the reinforced portion 14 of the flat circuit member 15 and the second linear arrangement of contact-portions, at each of which the contact point 33 provided on the second contact 18 comes into press-contact with the circuit-terminal 23 on the reinforced portion 14 of the flat circuit member 15, are formed to be parallel with each other. The first linear arrangement of contact-portions is made in the vicinity of the portion 36 of the insulated housing 16 to which the fixable portion 30 of each of the second contacts 18 is fixed and the second linear arrangement of contact-portions is made in the vicinity of the portion 35 of the insulated housing 16 to which the fixable portion 25 of each of the first contacts 17 is fixed. Consequently, the resilient press-force inflicted upon the flat circuit member 15 by the contact point 28 of each of the first contacts 17 and the resilient press-force inflicted upon the flat circuit member 15 by the contact point 33 of each of the second contacts 18 are well balanced to be dispersed within the reinforcing board member 13 accommodated, together with the reinforced portion 14 of the flat circuit member 15, in the board member accommodating portion 19 provided on the insulated housing 16 of the electrical connector 12, so that the reinforcing board member 13 is prevented from receiving an undesirable deflected press-force.

Incidentally, when the reinforcing board member 13 accompanied with the reinforced portion 14 of the flat circuit member 15 and accommodated in the board member accommodating portion 19 provided on the insulated housing 16 of the electrical connector 12 is required to get out of the board member accommodating portion 19, the tape-handle 13A attached to the flat circuit member 15 is pulled up to leave from the insulated housing 16, so that the flat circuit member 15 is drawn out of the board member accommodating portion 19.

The invention claimed is:

1. A circuit-terminal connecting device comprising;

an electrical connector having an insulated housing mounted on a main circuit board and a plurality of resilient contacts arranged on the insulated housing, each of said resilient contacts having a board connecting portion provided to be connected respectively to a plurality of first circuit-terminals provided on the main circuit board, and a flat circuit member having a reinforced portion attached to one of first and second surface portions opposite to each other of a reinforcing board member, said reinforcing board member being operative to engage with the insulated housing of the electrical connector and provided thereon a plurality of second circuit-terminals, wherein the resilient contacts include first and second contacts arranged one after the other and each of the first and second contacts has, in addition to the board connecting portion, a fixable portion provided to be fixed to the insulated housing and a resilient arm portion extending from the fixable portion to get under a board member accommodating portion provided on the insulated housing, wherein the resilient arm portion of each of the first and second contacts is provided with a contact point for coming into press-contact with the second circuit-terminal provided on the reinforced portion of the flat circuit member so as to cause the second circuit-terminals to be electrically connected respectively with the first circuit-terminals provided on the main circuit board through the first and second contacts and a locking portion for engaging with the other of the first and second surface portions of the reinforcing board member to lock the reinforcing board member, wherein the insulated housing of the electrical connector is provided thereon with the board member accommodating portion for accommodating the reinforcing board member accompanied with the reinforced portion of the flat circuit member, wherein a first portion of the insulated housing to which the fixable portion of each of the first contacts is fixed and a second portion of the insulated housing to which the fixable portion of each of the second contacts is fixed are provided to be opposite to each other with the board member accommodating portion of the insulated housing provided between the first and second portions, and wherein the contact point provided on the resilient arm portion extending from the fixable portion of each of the first contacts and the locking portion provided on the resilient arm portion extending from the fixable portion of each of the second contacts are placed on the side of the second portion of the insulated housing, and the contact point provided on the resilient arm portion extending from the fixable portion of each of the second contacts and the locking portion provided on the resilient arm portion extending from the fixable portion of each of the first contacts are placed on the side of the first portion of the insulated housing.

2. A circuit-terminal connecting device according to claim 1, wherein the board member accommodating portion has an opening portion opened into a direction perpendicular to a surface of the main circuit board on which the insulated housing is fixed and the reinforcing board member accompanied with the reinforced portion of the flat circuit member is accommodated in the board member accommodating portion through the opening portion of the board member accommodating portion.

3. A circuit-terminal connecting device according to claim 1, wherein the board member accommodating portion of the insulated housing is provided with a plurality of slits, in each of which the resilient arm portion of the first contact is put.

4. A circuit-terminal connecting device according to claim 1, wherein the first portion of the insulated housing is provided with a plurality of first slits, in each of which the locking portion provided on the resilient arm portion extending from the fixable portion of the first contacts is put, and the second portion of the insulated housing is provided with a plurality of second slits, in each of which the locking portion provided on the resilient arm portion extending from the fixable portion of the second contacts is put.

* * * * *